United States Patent [19]

Gregoire

[11] 3,978,619

[45] Sept. 7, 1976

[54] DOOR FRAME FOR AN OVERLAPPING DOOR

[76] Inventor: Jean-Claude Gregoire, 24 Saint-Martial D'Artenset, France

[22] Filed: Mar. 19, 1974

[21] Appl. No.: 452,665

[30] Foreign Application Priority Data

Mar. 20, 1973 France ..... 73.09905

[52] U.S. Cl. ..... 49/504; 49/380; 16/130; 312/140

[51] Int. Cl.[2] ..... E06B 1/04

[58] Field of Search ..... 49/504, 382, 380, 501; 16/130, 132, 134, 137

[56] References Cited

UNITED STATES PATENTS

| | | | |
|---|---|---|---|
| 384,954 | 6/1888 | Benedict | 16/132 |
| 532,044 | 1/1895 | Fagan | 16/130 |
| 1,141,303 | 6/1915 | Bennett et al. | 16/130 |
| 2,557,716 | 6/1951 | Allee | 16/137 |
| 2,910,154 | 10/1959 | Hammitt et al. | 49/504 |
| 3,008,741 | 11/1961 | MacCormack | 312/140 |
| 3,274,735 | 9/1966 | Stackhouse | 49/504 |
| 3,298,135 | 1/1967 | Kinser | 49/380 |
| 3,520,084 | 7/1970 | Gigante | 49/504 |
| 3,566,539 | 3/1971 | Ridgley | 49/380 |
| 3,772,735 | 11/1973 | Lautenschlaeger | 16/131 |
| 3,774,345 | 11/1973 | Cole et al. | 16/130 |

FOREIGN PATENTS OR APPLICATIONS

| | | | |
|---|---|---|---|
| 2,056,458 | 5/1971 | France | |
| 1,227,791 | 8/1960 | France | 49/501 |

*Primary Examiner*—Paul R. Gilliam
*Assistant Examiner*—Victor N. Sakran

[57] ABSTRACT

The door frame for an overlapping door has two posts which define facing vertical grooves which are of utility as a keeper for the latch or lock of the door mounted on the frame.

The front face of at least one of the posts has a vertical dovetail groove in which an extension of a fixed hinge part of a hinge is slidably engaged. For the purpose of holding the extension fast in the dovetail groove by the effect of friction at the desired height there is provided at least one screw which is screwthreadedly engaged in a tapped hole in the extension and has for effect to tighten the assembly between the extension and the surfaces of the dovetail groove.

11 Claims, 15 Drawing Figures

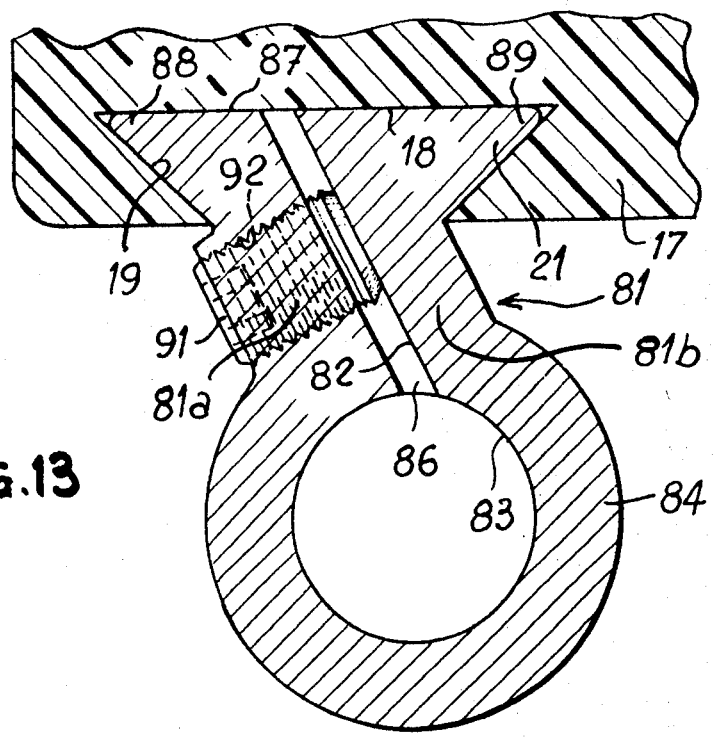
FIG. 13
FIG. 14
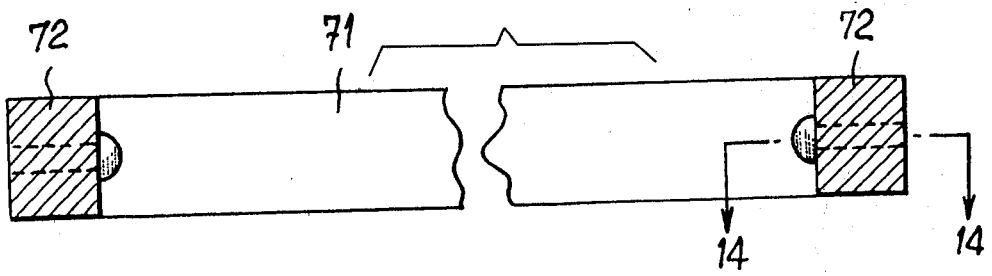
FIG. 15
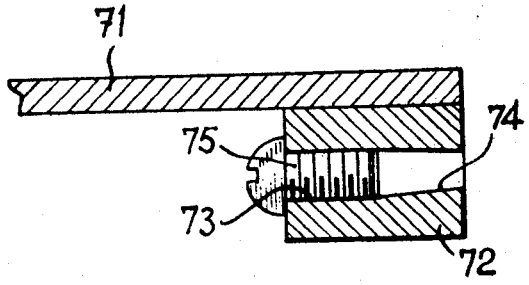

DOOR FRAME FOR AN OVERLAPPING DOOR

The present invention relates to door frames comprising in each post a vertical groove which is open toward the door passage and can constitute a keeper for the reception of the latch or lock of the door leaf.

It is known, in particular from French Patent No. 2,056,458, to fix in an inner vertical groove opposed to the groove employed as a keeper the fixed hinge parts of the hinges for mounting a door in a frame having a rabbet for receiving the door. This possibility has for advantage the fact that the door frame may be equipped for mounting a door which can open indifferently from the right or the left which is universally appareciated by architects and carpenters. However, the use of the vertical groove for fixing the hinges for an overlapping door that is to say a door which has a peripheral portion on three sides of the door which overlaps the door frame is only possible with the use of counter-cranked hinges which are costly to manufacture and moreover require a cutting operation which is very difficult to carry out so that the known door frame does not lend itself, for practical reasons, to the mounting of this type of overlapping door.

An object of the present invention is to provide a door frame of the aforementioned type in which there may be cheaply mounted with no particular difficulty an overlapping door. In this door frame, the front face of at least one of the posts includes in the known manner a vertical groove having a dovetail section in which an extension of a hinge part may be slidably engaged and secured in position in the groove by friction at any level under the effect of the clamping of at least one screw, the screw being engaged in a tapped hole in the extension.

Owing to the fact that the fixed hinge parts are fixed directly on the front face of the door frame post, the hinge may be of simple construction and easily mounted, the moving hinge parts, which are preferably hinge parts having a pin, being themselves capable of being placed in position without special difficulty on the overlapping door.

The proposed arrangement permits, as in the known door frames having a rabbet for receiving the doors, the equipment of the door frame indifferently for a right or left mounting of the door. For this purpose it is advantageous to arrange that the knuckles of the fixed hinge parts be open at both ends so as to be reversible.

Preferably, the extension of the fixed hinge parts define a prism which is engaged in the manner of a wedge in one of the corners of the dovetail-sectioned groove and which is held fast by the effect of the clamping and friction exerted by one or more pointed set screws which are screwed through the prism and whose end bears against the other corner of the dovetail groove. It is advantageous to arrange that each corner of the dovetail groove and that the corner of the prism have an angle of 60°, the set screw then traversing the prism in a direction perpendicular to the face of the latter which is applied against the corresponding side of the groove whereby the set screw is oriented in the direction of the bisector of the angle of the corner of the groove in which it bears.

It is also possible, in accordance with a modification of the invention, to arrange the extension of the fixed hinge parts in the form of an expansible member having two lips whose outer faces are, in the free state, planar and parallel, these faces being, when introduced in the dovetail groove, held fast by frictional contact with the sides of the dovetail groove under the action of cylindrical screws which are engaged in tapped holes in the hinge part and extend through the extension in the form of a cone which defines the inner surface of the two lips.

The posts and the upper rail of the door frame according to the invention are preferably section members of plastics material or drawn metal.

Further features and advantages of the invention will be apparent from the ensuing description with reference to the accompanying drawings.

In the drawings:

FIG. 13 is a plan view of another modification of the fixed hinge part;

FIG. 14 is a view, to an enlarged scale, of a spacer bar fixed to the lower part of the door frame shown in FIG. 1, and FIG. 15 is a sectional view taken on line 14—14 of FIG. 14.

Figure 1:
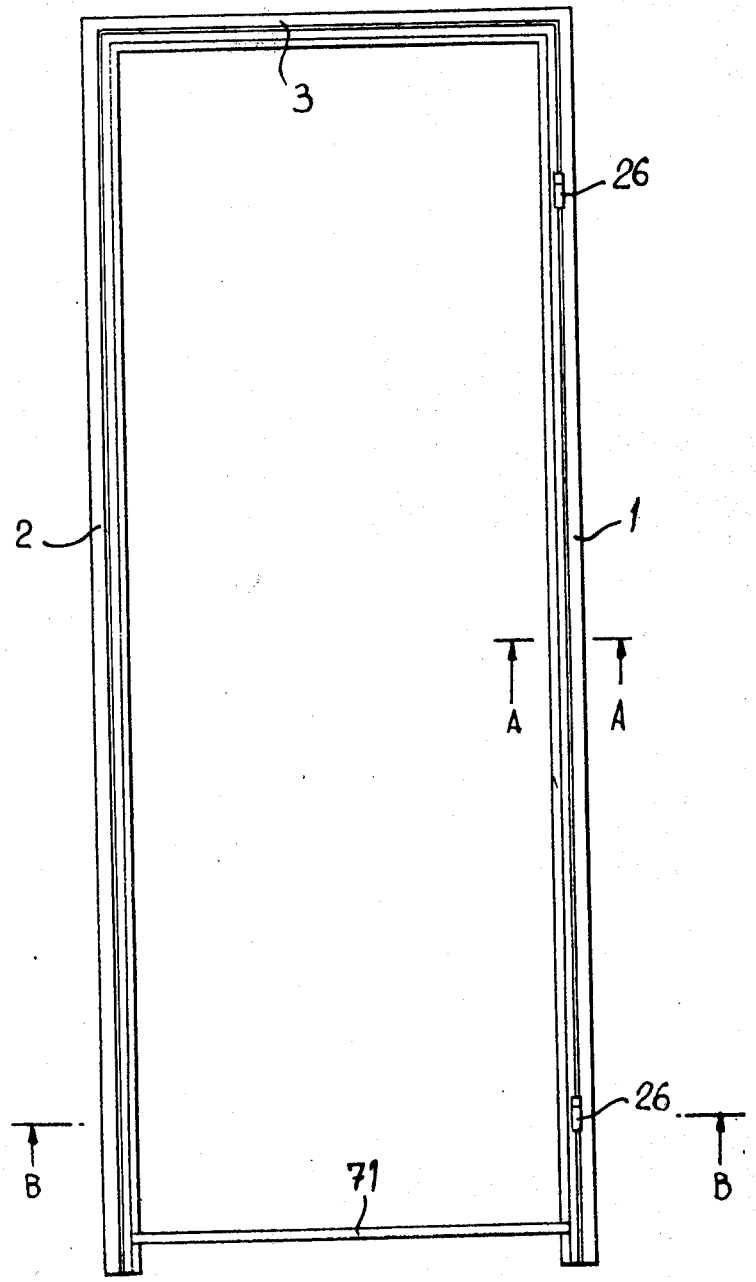
FIG. 1 is an elevational view of a door frame according to the invention having two hinges.
Figure 2:
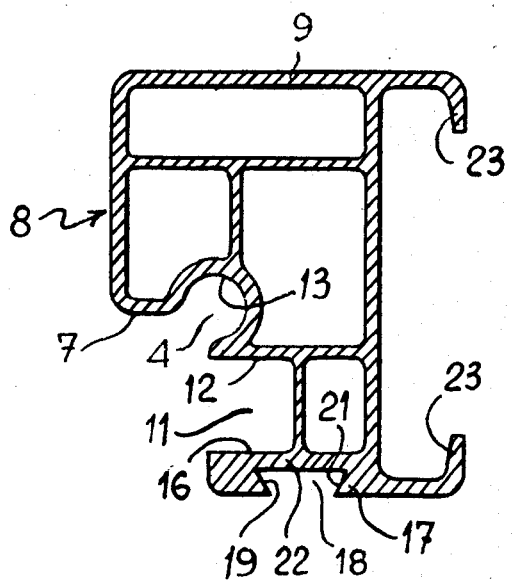
FIG. 2 is a sectional view of a post of the door frame shown in FIG. 1.
Figure 3:
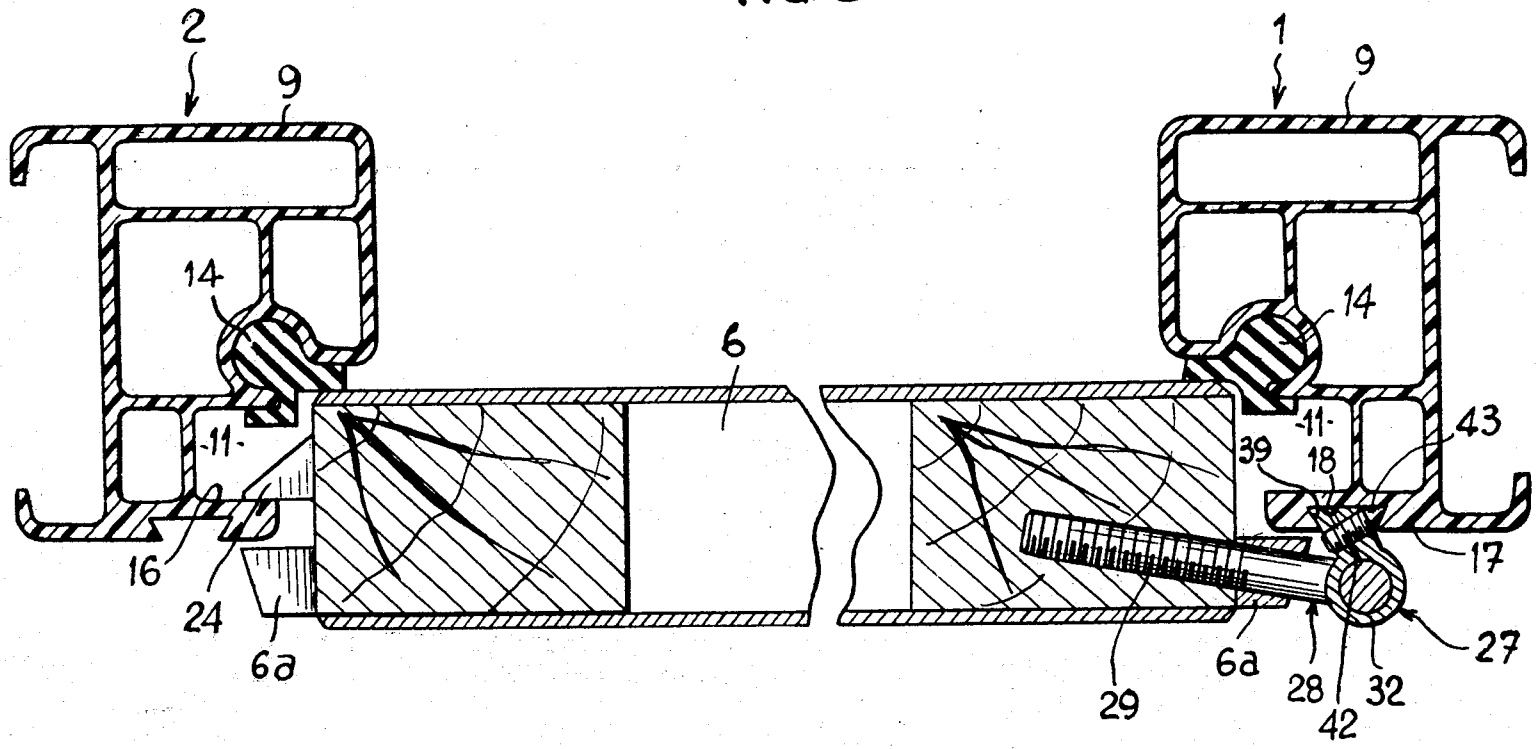
FIG. 3 is a horizontal sectional view of the door frame shown in FIG. 1 equipped with an overlapping door.

The two posts 1, 2 and the upper rail 3 of the door frame shown in FIG. 1 are made from section members of extruded plastics material which, as seen in FIG. 2, have a generally L-cross-sectional shape defining a rabbet 4 provided for receiving the main part of the door leaf or door proper 6 (FIG. 3).

The side 7 of the rabbet, which is parallel to the mean plane of the door frame, is solid and defines inwardly a portion 8 of the section member which has a partitioned structure and includes a planar end surface 9, whereas the other side of the rabbet is recessed and defines a groove 11 one of the sides 12 of which is adjacent a circular-section groove 13 disposed in the corner of the rabbet and adapted to retain a sealing and shock-absorbing member 14 against which the door leaf 6 bears. The other side 16 of the groove 11 defines the inner surface of a portion 17 of the door frame which defines the front face of the frame and in the thickness of which portion 17 there is formed a dovetail groove 18 which opens onto the front face and whose sides 19, 21 make an angle of 60° with the inner wall 22 of the groove. The end surface 9 and the facing portion 17 are extended on the sides thereof opposed to the opening of the door and define bent flanges 23 adapted to be retained by bedding or sealing tabs adapted to fix the posts in the wall or partition wall which must receive the door frame.

The groove 11 of the left post 2 constitutes a keeper which receives and retains by means of the side 16 the bolt or latch 24 of the door leaf 6 (FIG. 3).

The hinges 26 provided on the right post 1 comprise a fixed part 27, fixed in the dovetail groove 18 of the post, and a moving part 28 provided with a pin 29 which is screwed in an oblique direction in the door leaf 6 and traverses the edge portion 6*a* of this door leaf which partly overlaps the facing portion 17 of the posts.

The hinge pin 31, part of the moving hinge part 28, is engaged in the knuckle 32, open at both ends, of the fixed femal hinge female 27. This knuckle 32 (FIGS. 4 and 5) is in the form of an extension 33 which has the shape of a prism 34 having two parallel planar surfaces 36, 37 which make an angle of 30° with a diametral plane *a* of the knuckle 32 and a surface 38 which is perpendicular to the plane *a* and therefore makes an angle of 60° with the oblique surface 36. The two surfaces 36 and 38 thus define a wedge 39 (FIG. 3) which may be engaged in the corner, which also has an angle of 60°, defined by the left side 19 and the inner surface 22 of the dovetail groove 18 (FIG. 2). The hinge part 27 may be slid to any level with respect to the posts and fixed in position at the required level by the clamping and friction exerted by the wedge 39 against the corresponding sides of the dovetail groove under the effect of pointed set-screws 42 screwed in two tapped holes 41 which extend through the prism 34 and through the planar surfaces 36, 37, perpendicular to the latter and have an axis which coincides with the bisector of the angle between the side 21 and the inner surface 22 of the dovetail groove 18. The set-screws 42 each have a point 43 which defines a cone having an included angle of 60° and is forced in the corresponding corner of the groove.

Figure 7:
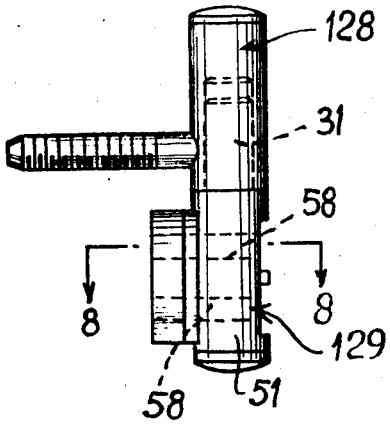
FIG. 7 is an elevational view of a modification of the hinge.
Figure 8:
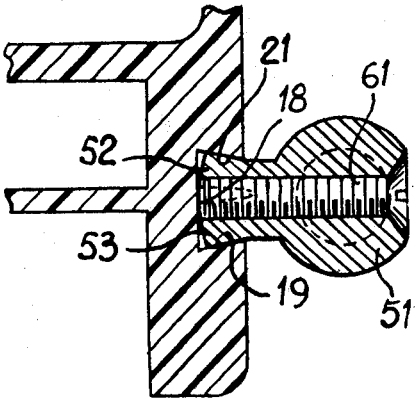
FIG. 8 is a sectional view taken on line 8—8 of the hinge shown in FIG. 7 whose fixed hinge part has been secured in position on the door frame post.
Figure 9:
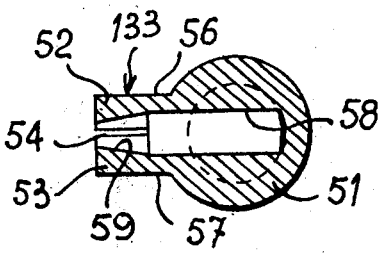
FIG. 9 is a cross-sectional view of the fixed hinge part of the hinge shown in FIG. 7 before it has been secured in position on the post.

In the modification shown in FIGS. 7, 8 and 9, the fixed hinge part 129 has a cylindrical portion 51 in which is fixed the hinge pin 31 on which pin is mounted the knuckle of the moving hinge part 128. The body 51 has an extension 133 which constitutes an expansible member having two lips 52, 53 which are separated by a slot 54 and which, in the free state, have planar parallel outer surfaces 56, 57 (FIG. 9). The body 51 has extending therethrough in the radial direction two tapped holes 58 which are extended in the extension 133 in the form of a convergent conical bore 59 the angle of which is such that, when the extension 133 is engaged in the dovetail groove 18 of the door frame posts, the screwing in the holes 58 of two cylindrical screws 61 causes, upon contact with the surfaces of the conical bores 59 defining the inner surfaces of the lips 52,53, an expansion of these lips which clamps them against the surfaces 19,21 of the dovetail groove 18 so that the extension, and consequently the hinge part, is held fast by friction.

Figure 10:
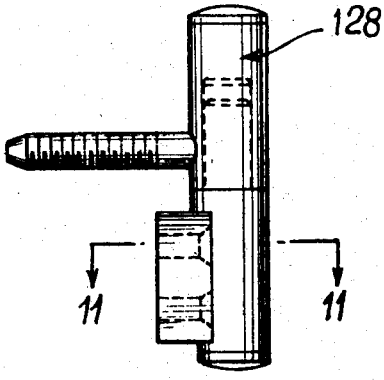
FIG. 10 is an elevational view of another modification of a hinge.
Figure 11:
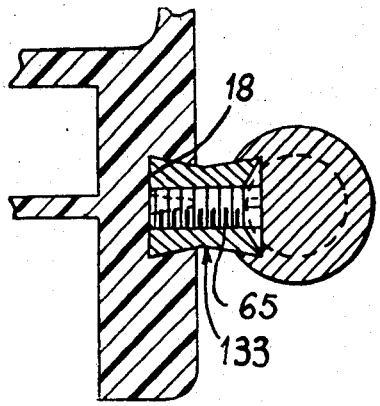
FIG. 11 is a sectional view taken on line 11—11 of the hinge shown in FIG. 10 after its fixed hinge part has been secured in position on the door frame post.
Figure 12:
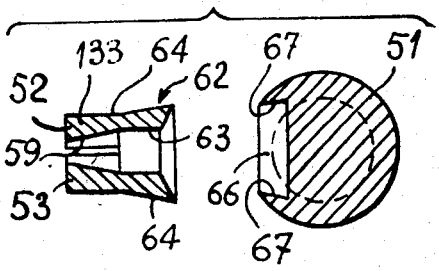
FIG. 12 is a cross-sectional view of the fixed hinge part of the hinge shown in FIG. 10 before it has been placed in position.

In the modification shown in FIGS. 10–12, the hinge part body 51 and the extension 133 are two separate members, the extension 133 having on the side thereof opposed to the lips 52, 53 a heel 62 having a tapped inner hole 63 and two divergent outer surfaces 64. The screwing of cylincrical screws 65 in the two holes 63 ensures, as in the embodiment shown in FIGS. 7–9, a wedging of the lips 52, 53 in the dovetail groove 18. After the extension 133 has been placed in position, the hinge part body 51 may be held fast with the extension 133 by the fitting of the heel 62 inside a recess 66 which has vertical sides 67 which are undercut or outwardly convergent and between which the divergent surfaces 64 of the heel 62 may be retained.

Figure 4:
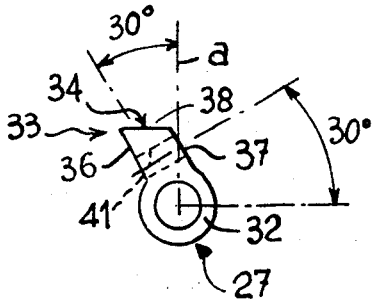
FIGS. 4 and 5 are plan and elevational views respectively of the fixed hinge part of the hinge shown in FIG. 3.
Figure 6:
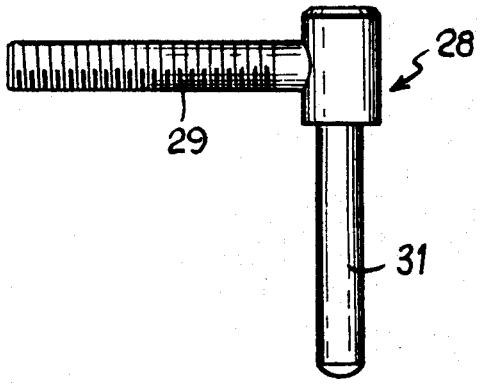
FIG. 6 is an elevational view of the moving hinge part of the hinge shown in FIG. 3.
Figure 5:
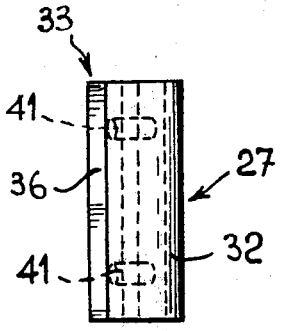

FIG. 13 shows a fixed hinge part whose extension 81 has a dovetail shape and approximately the same orientation as the extension 33 shown in FIG. 4 but which includes throughout its height a vertical slot 82 formed roughly on the median line of the extension 81. This slot extends from a point near to the centre bore 83 of the knuckle 84, at which there is formed an articulation 86, and opens onto the planar end surface 87 of the extension 81. The dovetail portion thus constitutes two wedges 88, 89 which may be engaged in the two corners of the dovetail groove 18 in the portion 17 defining the front face of the door frame and may be blocked therein under the effect of the spreading apart undergone by the two branches 81*a*, 81*b* of the extension 81 defined by the slot 82 when the two set-screws or grub-screws 91 engaged in tapped holes 92 perpendicular to the slot 82 of the branch 81*a* are urged against the other branch 81*b*.

FIGS. 14 and 15 show to an enlarged scale a spacer bar 71 which in FIG. 1 retains the lower ends of the posts 1,2. The ends of the bar 71 are provided with a clamping wedge 72 of expansible material. Each clamping wedge has a bore parallel to the direction of the bar 71 and has a cylindrical and tapped portion 73 extended by a portion 74 which has a taper which diminishes the opening of the bore so that, when the corresponding end of the bar 71 is inserted in the groove 11 of the door frame post, the screwing in the cylindrical portion 73 of a screw 75 results in an expansion of the portion of the wedge 72 which includes the tapered portion 74 and a clamping which holds the bar in position in the groove 11.

The hinge parts described are advantageously of plastics material including if desired the hinge pin 31 but to the exclusion of the pin 29 which is preferably of steel.

Having now described my invention what I claim as new and desire to secure by Letters Patent is:

1. A door frame structure for an overlapping door, comprising in combination a door frame and hinge means for mounting the door on the frame, the frame defining a front face for receiving a peripheral portion of the door in overlapping relation to the front face and having two posts defining between the posts a door passage, each post having a vertical groove which is open toward the door passage, one of the grooves being a keeper for latch means of the door, at least one of the posts having a vertical groove of dovetail cross-sectional shape defining two corners in cross-section and provided in a part of said front face corresponding to said one of the posts, said hinge means comprising a fixed hinge part, an extension in fixed relation to the hinge part and slidably engaged in the dovetail groove and having a shape complementary thereto and a screw screwthreadedly engaged in the extension the assembly consisting of the extension and screw defining a structure which has in said cross-section two corners which engage said two corners of the dovetail groove and are capable of being spread apart and urged into the dovetail groove corners by rotation of the screw for tightening the assembly in the dovetail groove whereby the extension is held fast at the desired level in the dovetail groove.

2. A door frame structure as claimed in claim 1, wherein the dovetail groove is formed in the thickness of a front portion of the post defining said front face, the front portion having an inner surface which defines a side of the corresponding groove for the latch means.

3. A door frame structure as claimed in claim 1, wherein the dovetail groove is defined by two inclined sides and an inner surface and the extension of the hinge part comprises at least one prismatic portion engaged with one of the sides and with the inner surface of the dovetail groove.

4. A door frame structure as claimed in claim 1, wherein the dovetail groove is defined by two inclined sides and an inner surface and each side of the dovetail groove makes an angle of 60° with the inner surface of the dovetail groove.

5. A door frame structure for an overlapping door, comprising in combination a door frame and hinge means for mounting the door on the frame, the frame defining a front face for receiving a peripheral portion of the door in overlapping relation to the front face and having two posts defining between the posts a door passage, each post having a vertical groove which is open toward the door passage, one of the grooves being a keeper for latch means of the door, at least one of the posts having a vertical groove of dovetail cross-sectional shape defining two corners in cross-section and provided in a part of said front face corresponding to said one of the posts, said hinge means comprising a fixed hinge part, an extension in fixed relation to the hinge part and slidably engaged in the dovetail groove and a screw screwthreadedly engaged in the extension, the extension defining a prism which is engaged in the manner of a wedge in one of the corners of the dovetail groove and the screw being a set-screw having a substantially pointed end portion which bears against the other corner of the dovetail groove so that the screwing of the screw has a clamping and frictional effect and holds the prism fast in the groove.

6. A door frame structure as claimed in claim 5, wherein the dovetail groove is defined by two inclined sides and an inner surface and the prism has a corner of 60° and the set-screw extends through a tapped hole in the prism which makes an angle of 90° with a surface of the prism applied against the corresponding inclined side of the dovetail groove whereby the set-screw is contained in a plane of a bisector of the angle of the corresponding inclined side of the dovetail groove in which it bears.

7. A door frame structure as claimed in claim 1, wherein the extension of the fixed hinge part constitutes an expansible member having two lips defining in the free state planar parallel outer surfaces and the fixed hinge part comprises at least one tapped hole which is extended in the extension in the form of a convergent conical bore in the free state of the lips, and a cylindrical screw screwthreadedly engaged in the tapped hole and in the conical bore and holding the lips spread apart under the effect of the included angle of the conical bore so that the outer surfaces of the lips are urged tightly against the inclined sides of the dovetail groove.

8. A door frame structure as claimed in claim 7, wherein the expansible extension constitutes a separate member adapted to be rendered integral with the fixed hinge part after the extension has been fixed in the dovetail groove.

9. A door frame structure as claimed in claim 8, wherein the separate member constituting the expansible extension is rendered integral with the fixed hinge part by the fitting of a free end portion of the extension in a recess in the fixed hinge part.

10. A door frame structure as claimed in claim 1, wherein the fixed hinge part has a knuckle portion defining a bore for a hinge pin and the extension of the fixed hinge part has an oblique orientation parallel to which orientation there is formed, throughout the height of the extension, a vertical slot which opens onto an end surface of the extension and is separated from the bore of the knuckle by a portion constituting an articulation so that the extension is divided into two branches constituting two wedges, there being provided at least one set-screw which is screwthreadedly engaged in one of the two branches and urged against the other of the two branches so that the two wedges are tightly engaged in and locked in the corners of the dovetail groove by the effect of the set-screw.

11. A door frame structure as claimed in claim 1, comprising a moving hinge part pivotably mounted on the fixed hinge part and having a pin for screwing into and securing to the door.

* * * * *